US006279189B1

(12) United States Patent
Cassar

(10) Patent No.: US 6,279,189 B1
(45) Date of Patent: Aug. 28, 2001

(54) FLEXIBLE INSERT WITH STOP LIMITS FOR BRUSH BROOM HANDLES

(76) Inventor: Simon Ralph Cassar, 36804 Solvay St., Palmdale, CA (US) 93552

( * ) Notice: Subject to any disclaimer, the term of this patent is extended or adjusted under 35 U.S.C. 154(b) by 0 days.

(21) Appl. No.: 09/435,451

(22) Filed: Nov. 22, 1999

(51) Int. Cl.[7] ..... A46B 5/00
(52) U.S. Cl. ..... 15/144.1; 15/172
(58) Field of Search ..... 15/144.1, 228, 15/172

(56) References Cited

U.S. PATENT DOCUMENTS 2,221,128 * 11/1940 Bates .
3,395,416 * 8/1968 Hughes .
5,269,038 * 12/1993 Bradley .
5,384,930 * 1/1995 Uno ..... 15/144.1
5,406,670 * 4/1995 Juratovac .
5,671,497 * 9/1997 Abdo ..... 15/144.1
6,006,393 * 12/1999 Lynch .
6,058,551 * 5/2000 Tagliavini ..... 15/144.1
6,073,298 * 6/2000 O'Brien ..... 15/144.1

* cited by examiner

*Primary Examiner*—Randall E. Chin

(57) ABSTRACT

An attachment in which the flexible member is rectangular in shape and has limit stops which are affixed at a location between the handle and the head of a brush broom to provide a controlled flexible member at the junction where the handle is attached to the head. Through the use of the controlled flexible member being rectangular in shape, the handle maintains rigidity in the direction in which the brush broom head is moved but is flexible in the lateral direction and therefore can be bent at controlled angles relative to the head. Therefore, when the brush broom head comes in contact with a stationary object such as the leg of a table, the brush broom head will flex or flow around the object without damage to the broom head or object.

22 Claims, 3 Drawing Sheets

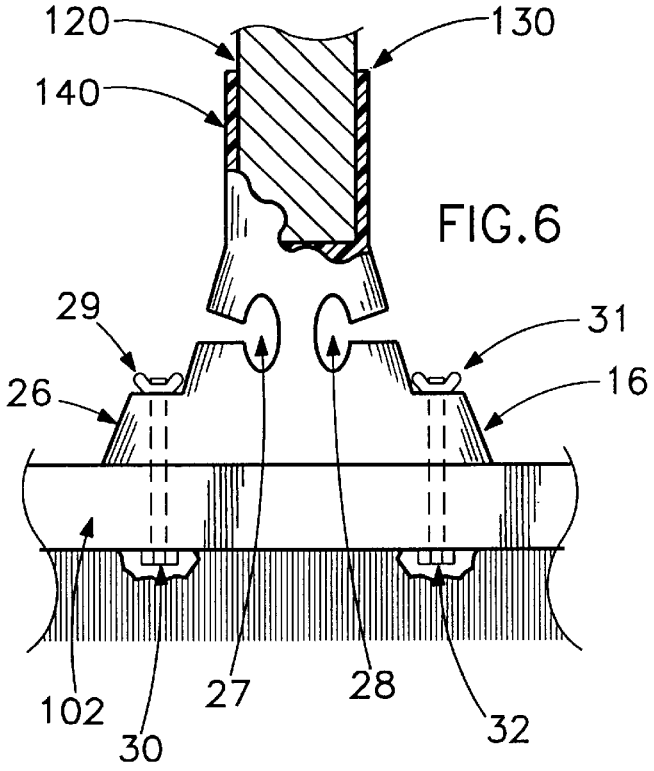
FIG.6
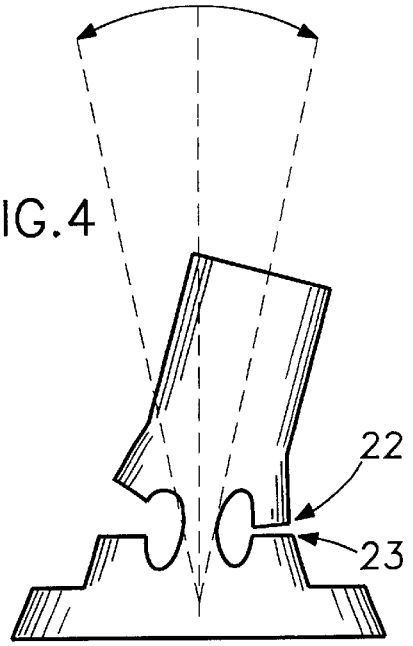
FIG.4
FIG.5
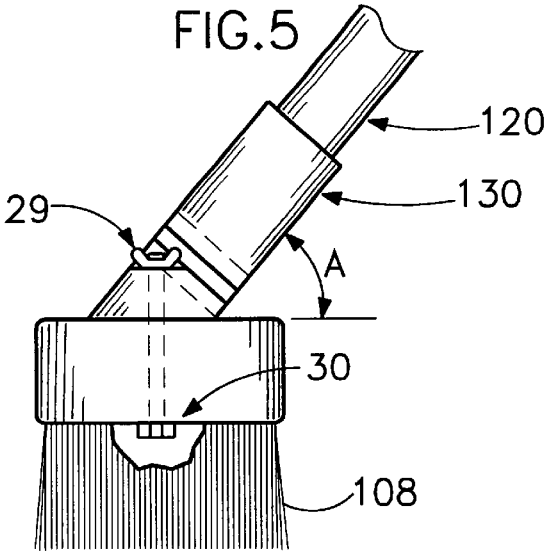

FLEXIBLE INSERT WITH STOP LIMITS FOR BRUSH BROOM HANDLES

BACKGROUND OF THE INVENTION

1. Field of the Invention

The present invention relates to a cleaning or sweeping apparatus and in particular, to brooms or applications where material is being removed by an apparatus. The present invention further relates to insert adjustments which can enhance the ease of use and cleaning capability of brooms.

2. Description of the Prior Art

The standard brush broom has two primary components. The first component is the head that comprises a rectangular piece of material usually made of wood that supports therein a multiplicity of bristles of fibers that extend transversely to the head. The second primary component of the brush broom is the handle which is usually a cylindrical pole that is rigidly although sometimes removably affixed to the top of the head in the manner which permits the brush broom to be pushed and pulled by the exertion of a force on the handle.

One significant problem with brush brooms especially when used in confined spaces is that the rigid nature of the connection between the handle and head causes difficulty in sweeping adjacent doorways, corners, tables, chairs and other areas where obstacles are placed on the floor. The edge of the broom head hits the obstacle straight on and then it is necessary to stop the sweeping action and reorient the push broom to avoid or go around the obstacle. In addition, if the force of the sweeping action is sufficiently strong, the head-on impact of the brush broom could cause damage to the object being hit inflicting injury to the operator or break the push broom handle. The reason for the damage is due to the moment between the handle and broom head length cause a fulcrum effect. To overcome this problem prior art has been developed to allow the brush broom to be flexible at the joint between the brush broom and pole handle. However, to effectively have a workable flexible brush broom, it must have stops to limit the amount of flex and the attachment must be rectangular in shape along the longitudinal axis to retain the rigidity in the longitudinal axis while being flexible in the lateral axis.

Prior art has been patented on mechanisms or attachments that allow for a flexible joint between the brush broom and broom handle. However, to date all prior art is either too costly to manufacture, due to the expense of springs and their installation into the broom head, e.g., U.S. Pat. Nos. 3,506,996 and 4,785,489, or in the case of polymeric or polyurethane adapter U.S. Pat. Nos. 4,722,634 and 5,333,345, have excessive flex causing a wobble effect because the flexible attachments were not rectangular in shape and had no limit stops. The prior art allows the broom to have excessive lateral movement when in contact with a stationary object thus causing the contents to be swept, instead of being retained in the brush broom bristles, due to the excessive angle of the brush broom in relation to the broom handle. In addition, without stop limits, the prior art allows the flex member to go beyond the stress limit of the flexible insert material, causing the flexible membrane to crack and eventually break thus rendering it ineffective. In addition, the prior art flexible insert attachments are not rectangular in shape along the longitudinal axis which is critical to reduce stress to the flexible member yet allow for lateral movement and retain the rigidity in the forward and aft movements. The cylindrical attachment described in the prior art causes the flexible member to flex in both the lateral direction and longitudinal direction making the broom head unstable. In addition, U.S. Pat. No. 5,333,345 uses a polyurethane flexible material and requires flanges to be encapsulated into the polyurethane elastomer material, thus making the adapter cost prohibitive for residential and commercial brooms.

Therefore, a significant need exists to improve upon the previous patents and to allow for a flexible attachment to be made that is rectangular in shape and has limit stops, thus eliminating stress to the flexible apparatus yet limiting the wobble effect of a flexible mechanism/attachment both in the lateral and longitudinal axis. It is also desirable to manufacture a brush broom that is flexible so that comers, doorways and obstacles on the floor can be more easily negotiated when it is necessary to sweep adjacent or around them.

SUMMARY OF THE INVENTION

The present invention is a mechanism that is affixed at the location between the brush handle and the head of the brush broom to provide a flexible member at the junction where the handle is attached to the head. Through use of the flexible member and predetermined limit stops, the handle maintains rigidity in the direction in which it is moved but is flexible in the lateral direction up to the predetermined limits of the stops. Therefore, when the brush broom comes in contact with a stationary object, the broom will only flex up to the stress limit of the flexible material due to the limit stops yet have sufficiently enough movement to reduce hand injury to the operator or damage to the structure or brush broom handle.

It has been discovered that all elastomer materials have certain flexible characteristics that cannot be controlled unless physical stops have been incorporated into the design of the apparatus. According to the present invention, the design incorporates a positive stop to eliminate the broom head from flexing beyond the limits of the memory of the material. In addition the limit stops allow for control of the flexible movement thus eliminating a wobble effect, when the broom head goes out of control which makes the broom head unusable for cleaning purposes.

It has been further discovered that to reduce stress to the material yet retain rigidity in the forward and aft movements, flexible materials having a flexible memory such as molded rubber, plastic or even formed metals perform best when they are rectangular in shape, when viewed in a cross sectional along the longitudinal Z axis with the long side of the rectangle being forward and aft and the short side being inboard and outboard as shown in FIG. 3 item 18. This configuration allows for maximum flexibility in the lateral movement yet has rigidity in the forward and aft movements.

It is therefore an object of the present invention to provide an apparatus by which a conventional brush broom can efficiently utilize a flexible insert that has controlled limits and can be economically manufactured.

It is a further object of the present invention to provide an insert that can be adapted to existing brush brooms to provide the controlled flexibility.

It is an additional object of the present invention to provide an insert which can be attached to the forward end of the handle to thereby provide the option of manufacturing a handle with the insert attached which can be affixed to the top of the head of a brush broom.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 4 is a front elevational view of the preferred embodiment of the present invention insert apparatus illustrating the movement of the attachment and the use of the control limit stops when the brush broom comes in contact with a stationary object.

FIG. 5 is a side elevational view of the preferred embodiment of the present invention insert apparatus attached to the top of the head and attached adjacent to the forward end of the handle of a brush broom.

FIG. 6 is a front elevational view as shown in FIG. 1, showing a partial cross section of a preferred embodiment and an alternative embodiment of the attachment method of the present invention.

DETAILED DESCRIPTION OF THE PREFERRED EMBODIMENTS

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Figure 1:
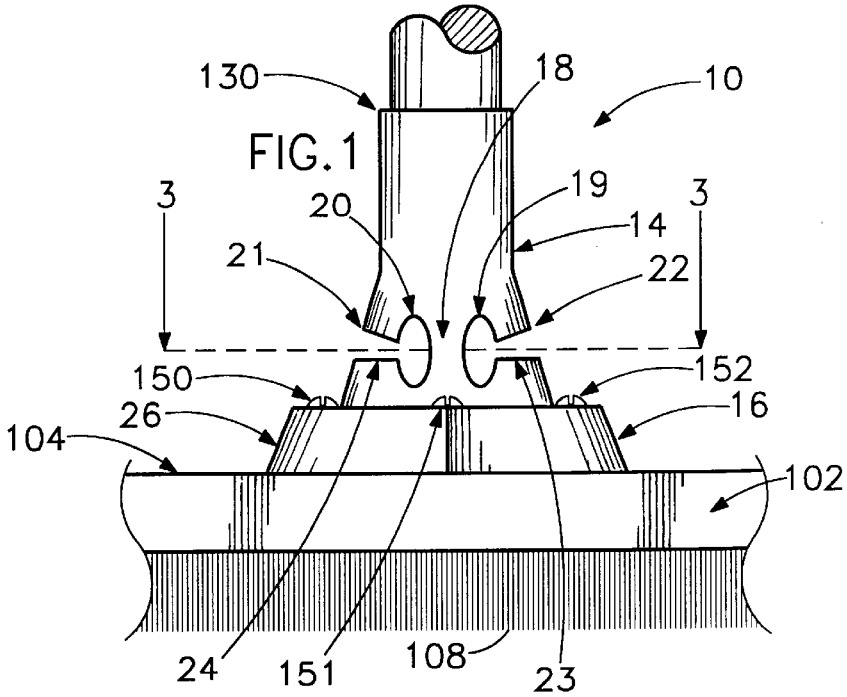
FIG. 1 is a perspective view of the preferred embodiment of the present invention insert apparatus attached to the top of the head and attached adjacent to the forward end of the handle of the brush broom.
Figure 7:
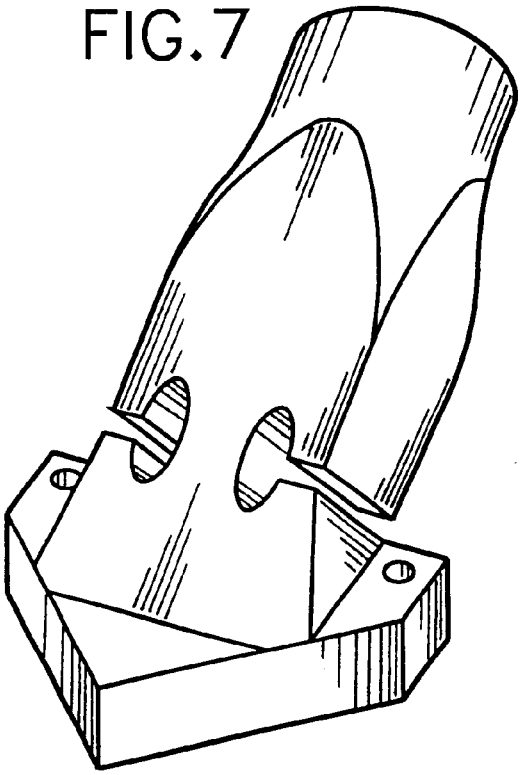
FIG. 7 is an isometric view of the present attachment.

Referring to FIG. 1, there is shown at 10 the present invention flexible stop controlled insert member acting as a stop limit mechanism. In the preferred molded embodiment, the flexible insert member 10 comprises a longitudinal section 14 and a lateral section 16 that are interconnected through an arcuate connecting section 18. In general appearance, the one piece molded insert looks like a pyramid shaped object with two elongated holes 19 and 20 that are open on both the left and right outboard side of the insert with the top portion of the triangle pyramid shape having a circular receptacle to receive the broom handle. The alignment and shape of the two elongated holes 19 and 20 are symmetrical and extend away from each other. The overall configuration of the flexible control stop member 10 resembles an inverted "T" with the mid portion of the vertical leg being thin in the middle and the lower and top portions of the leg being thick and wide thus allowing for control stops. The singular molded body unit has two symmetrical open-ended cavities 19 and 20. Each cavity is arcuate in design and forms tops 21 and 22 and bottoms 24 and 23 stop pads that lie around the lateral axis. The gap between the stop pads 21, 24 and 22, 23 respectively, can vary to allow the brush broom head to flex between 3 degrees to up to 75 degrees depending on the application type of the brush broom type. Typically the gap distance between the stop limits is set to allow no more than 30 degrees broom head to broom handle deflection.

When the broom head comes in contact with an object, the lower stop pad 23 will come in contact with stop pad 22 thus causing the broom head not to continue the flex movement and thus reducing debris loss during sweeping.

In the embodiment illustrated in FIG. 6, the lower base mount portions 26 and 16 protrude upward and merge into a cylindrical sleeve portion. The upper cylindrical portion extends upwardly and outwardly preferably at an angle of inclination of approximately 45 degrees in relation to the base mount as shown in FIG. 5, item "A". Accordingly, the upper sleeve portion of the cylindrical sleeve section 130 includes an axial bore 140 having a uniform dimension so as to receive the transverse dimension of the handle 120. The thickness of the material encapsulating handle 120 is sufficient to not crack when impact to the head of the broom occurs. The upper sleeve section 130 has a diameter to tightly receive in a generally slip-fit relationship the transverse dimension of the handle to frictionally retain the handle therein.

In the preferred embodiment, the insert member 10 is made of any flexible substance with memory such as rubber, plastic, titanium, and polyvinyl. It is also within the spirit and scope of the present invention for the attachment to be made of flexible but strong plastic such as Mylar™, polypropylene or any other flexible material exhibiting the required characteristics.

The preferred embodiment of the present invention is shown in use in FIGS. 1, 2, 3, 4 and 6. The conventional brush broom 100 comprises ahead member 102 and a handle 120. The head 102 in turn comprises a top surface 104 and a bottom surface 106. The bottom surface 106 supports a multiplicity of bristles or fibers 108 that are cut so as to be aligned in the same plane 110 when the head 102 is flush against the floor during a sweeping operation. The handle 120 is an elongated member that in the preferred embodiment for ease of gripping is a pole. When fitted with the preferred embodiment of the insert apparatus 10, the handle 120 is encapsulated into recess 140 which is of sufficient length to accommodate sufficiently enough length of the longitudinal handle 120. The molded apparatus is comprised of left and right recessed cavities 27 and 28 respectively that are open on both sides of the embodiment that form the upper and lower left side stops 21 and 24 and right side stops 22 and 23. The two recessed cavities share the same back portion of the cavity that forms the rectangular flexible member 18. The recessed cavities are elongated along the Y axis to allow for the member to flex in the lateral movement as shown in FIG. 4. Lower stops 24 and 23 of the flexible insert member form the base of the attachments 26 and 16. The base of the attachment is supported onto the broom head by screws 150, 151 and 152 that connect the attachment to the broom bead.

In order to facilitate the ease of motion for the sweeper, the longitudinal section 14 (and flexible member 18) is offset at an angle relative to its respective lateral sections 26 and 16. As illustrated in FIG. 5, the preferred relative angle "A" is approximately 45 degrees, although any angle from approximately 15 degrees to approximately 80 degrees is allowed.

An alternative embodiment for the base of the attachment is illustrated in FIGS. 5 and 6. In this embodiment, the bases 26 and 16 are attached to the brush broom head by two bolts 30 and 32 that are inserted through the broom head bottom adjacent to the bristles as shown in FIGS. 6 and 5, and connect the attachment to the brush broom head with wing nuts 29 and 31. As in the preferred embodiment, the stop limit mechanism is identical in design and material as to the aforementioned alternative embodiment.

Figure 2:
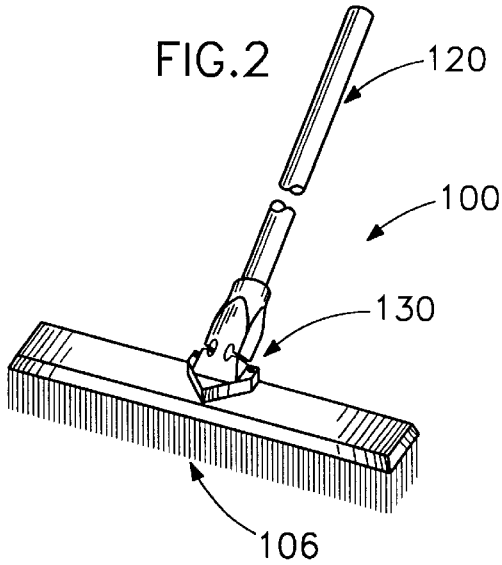
FIG. 2 is a perspective view of the preferred embodiment of the present invention insert apparatus attached to the top of the head and attached adjacent to the forward end of the handle of a brush broom.
Figure 3:
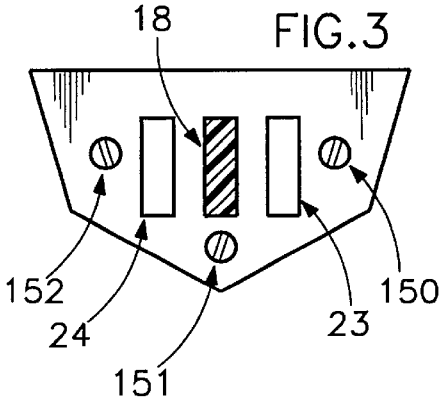
FIG. 3 is a cross-sectional view looking down along line 3—3 of FIG. 1.
Figure 8:
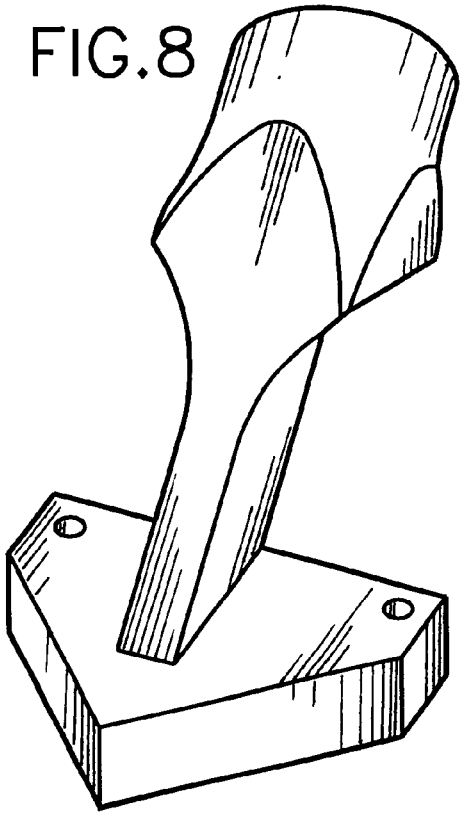
FIG. 8 is an isometric view of the alternative embodiment.

An alternative embodiment is identical to the preferred embodiment with the flexible member having a rectangular shaped flexible member as indicated in FIG. 3, item 18 and being a one-piece unitary molded attachment. The difference between the preferred attachment and the alternative attachment is that the limit stops have been removed as indicated in FIG. 8.

Defined broadly, the present invention is a flexible insert member with stop limits that is attached to one end of a brush broom handle and attached to the bead of the brush broom to thereby provide a controlled flexible connection between the handle and head of the brush broom, the flexible insert being rigid in the longitudinal direction to permit the handle to cause the broom head to move back and forth and the flexible insert being flexible with stop limits in the lateral direction to thereby permit the handle to flex laterally with respect to the head of the brush broom.

Therefore, through use of the present invention, a flexible sweeper can be manufactured that is economical and durable and thus allow a person doing the sweeping to sweep liberally and freely without worry of nicking or denting fixture and household trim along with reducing hand injury due to sudden broom impact. At the same time, the brush broom has the rigidity to push or pull large loads without flexing beyond a predetermined degree via the stop limits. The life of the broom handle is also increased.

Of course the present invention is not intended to be restricted to any particular form or arrangement, or any specific embodiment disclosed herein, or any specific use, since the same may be modified in various particulars or relations without departing from the spirit or scope of the claimed invention herein above shown and described of which the apparatus shown is intended only for illustration and for disclosure of an operative embodiment and not to show all of the various forms or modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. A brush broom, comprising:

a. an elongated laterally disposed head member having a top surface and a bottom surface;

b. a plurality of bristles each having one end affixed to said bottom surface of said head member and extending downwardly therefrom;

c. a unitary flexible insert member having a mounting section, an inclined longitudinal section and a flexible connecting section integrally connecting the mounting section with the longitudinal section, the mounting section centrally affixed to said top surface of said head member such that the longitudinal section extends upwardly and outwardly to form an angle relative to the mounting section, the longitudinal section having an axial bore with an open end;

d. an elongated handle member having one end press-fitting from said open end and secured within said axial bore of said longitudinal section of said flexible insert member; and e. said flexible connecting section having a pair of symmetrical arcuate recesses located on opposite sides and extending the width of said flexible connecting section, each arcuate recess forming an upper engagement pad and a lower stop limit pad, where the upper engagement pad and its respective lower stop limit form a predetermined gap distance for allowing lateral flexing of said longitudinal section and said handle member between the range of approximately 3°–75°;

f. whereby said flexible insert member allows said handle member to maneuver said head member to be pushed back and forth while at the same time allows said handle member to move laterally relative to said head member and when said head member comes in contact with an object, either one of said upper engagement pads comes in contact with its respective aligned lower stop limit pad and thereby prevents said handle member from lateral movement such that said flexible insert member prevents said handle member from breaking-off from said head member.

2. The brush broom in accordance with claim 1, further comprising at least two bolts inserted through said bottom surface of said head member and through bores in said mounting section of said flexible insert member and secured thereto by at least two corresponding wing nuts.

3. The brush broom in accordance with claim 1, further comprising at least two bolts inserted through openings in said mounting section and threadedly inserted into said top surface of said head member.

4. The brush broom in accordance with claim 1, wherein said angle is approximately between the range of 15° to 80°.

5. The brush broom in accordance with claim 1, wherein said flexible insert member is made out of plastic material.

6. The brush broom in accordance with claim 1, wherein said flexible insert member is made out of elastomer material.

7. The brush broom in accordance with claim 1, wherein said flexible connecting section is a rectangular shape.

8. A flexible insert member to be used in conjunction with a brush broom having a handle and a laterally disposed cleaning head with a top surface, a bottom surface and a plurality of bristles attached to the bottom surface and extending downwardly therefrom, the flexible insert member comprising:

a. a unitary flexible body having a mounting section, a longitudinal section and a flexible connecting section integrally connecting the head section with the longitudinal section, the longitudinal section having an axial bore with an open end for receiving and securing one end of said handle thereto;

b. said flexible connecting section having a pair of symmetrical arcuate recesses located on opposite sides and extending the width of said flexible connecting section, each arcuate recess forming an upper engagement pad and a lower stop limit pad, where the upper engagement pad and its respective lower stop limit form a predetermined gap distance for allowing a predetermined angle of lateral flexing of said longitudinal section and said handle; and c. means for centrally attaching said mounting section to said top surface of said head of said brush broom such that said longitudinal section extends upwardly and outwardly to form an angle relative to said mounting section;

d. whereby said flexible insert member allows said handle to maneuver said head of said brush broom to be pushed back and forth while at the same time allows said handle to move laterally relative to said head and when said head comes in contact with an object, either one of said upper engagement pads comes in contact with its respective aligned lower stop limit pad and thereby prevents said handle from lateral movement such that said flexible insert member prevents said handle from breaking-off from said cleaning head.

9. The flexible insert member in accordance with claim 8, wherein said means for centrally attaching said mounting section to said top surface of said head of said brush broom includes at least two bolts inserted through said bottom surface of said head and through bores in said mounting section of said flexible body and secured thereto by at least two corresponding wing nuts.

10. The flexible insert member in accordance with claim 8, wherein said means for centrally attaching said mounting section to said top surface of said head of said brush broom includes at least two bolts respectively inserted through the top of said mounting section and threadedly inserted into said head of said brush broom.

11. The flexible insert member in accordance with claim 8, wherein said flexible body is made out of elastomer material.

12. The flexible insert member in accordance with claim 8, wherein said flexible body is made out of plastic material.

13. The flexible insert member in accordance with claim 8, wherein said angle is approximately between the range of 15° to 80°.

14. The flexible insert member in accordance with claim 8, wherein said predetermined angle of lateral flexing is approximately between the range of 3°to 75°.

15. The flexible insert member in accordance with claim 8, wherein said flexible connecting section is a rectangular shape.

16. An attachment member to be used in conjunction with a cleaning apparatus having a handle and a laterally disposed cleaning head, the attachment member comprising:

a. a body made of elastomer material and having a mounting section, a longitudinal section and a flexible connecting section connecting the mounting section with the longitudinal section, the longitudinal section for receiving and securing one end of said handle thereto;

b. said flexible connecting section having a thickness which is thinner than the thickness of said mounting section and said longitudinal section for allowing a predetermined angle of lateral flexing of said flexible connecting section with said longitudinal section; and c. means for attaching said mounting section to said cleaning head of said cleaning apparatus such that said longitudinal section extends upwardly and outwardly to form an angle relative to said mounting section;

d. whereby said attachment member allows said handle to maneuver said cleaning head of said cleaning apparatus to be pushed back and forth while at the same time allows said handle to move laterally relative to said cleaning head.

17. The attachment member in accordance with claim 16, wherein said means for attaching said mounting section to said cleaning head of said cleaning apparatus includes at least two bolts inserted through said cleaning head and through said mounting section of said body and secured the by at least two corresponding wing nuts.

18. The flexible insert member in accordance with claim 16, wherein said means for attaching said mounting section to said top surface of said head includes at least two bolts respectively inserted through the top of said mounting section and threadedly inserted into said head of said cleaning apparatus.

19. The attachment member in accordance with claim 16, wherein said angle is approximately between the range of 15° to 80°.

20. The attachment member in accordance with claim 16, wherein said predetermined angle of lateral flexing is approximately between the range of 3° to 75°.

21. The attachment member in accordance with claim 16, wherein said flexible connecting section comprises a pair of symmetrical arcuate recesses located on opposite sides and extending the width of said flexible connecting section, each arcuate recess forming an upper engagement pad and a respective lower stop limit pad such that when said cleaning head comes in contact with an object, either one of the upper engagement pads comes in contact with its respective lower stop limit pad and thereby prevents said handle from lateral movement such that said attachment member prevents said handle from breaking-off from said cleaning head.

22. The attachment member in accordance with claim 16, wherein said flexible connecting section is a rectangular shape.

* * * * *